US006483924B1

(12) United States Patent
Kirjavainen

(10) Patent No.: US 6,483,924 B1
(45) Date of Patent: Nov. 19, 2002

(54) ACOUSTIC ELEMENTS AND METHOD FOR SOUND PROCESSING

(75) Inventor: Kari Kirjavainen, Espoo (FI)

(73) Assignee: Panphonics Oy, Tampere (FI)

( * ) Notice: Subject to any disclaimer, the term of this patent is extended or adjusted under 35 U.S.C. 154(b) by 0 days.

(21) Appl. No.: 09/125,423

(22) PCT Filed: Feb. 26, 1997

(86) PCT No.: PCT/FI97/00125

§ 371 (c)(1),
(2), (4) Date: Aug. 19, 1998

(87) PCT Pub. No.: WO97/31506

PCT Pub. Date: Aug. 28, 1997

(30) Foreign Application Priority Data

Feb. 26, 1996 (FI) ..... 960861

(51) Int. Cl.[7] ..... H04R 25/00
(52) U.S. Cl. ..... 381/191; 381/113; 381/116
(58) Field of Search ..... 381/191, 116, 381/111, 113, 354

(56) References Cited

U.S. PATENT DOCUMENTS 3,008,014 A * 11/1961 Williamson et al. ..... 381/116
3,136,867 A * 6/1964 Brettell ..... 381/116
3,851,183 A * 11/1974 Lewiner et al. ..... 381/191
3,896,274 A * 7/1975 Fraim et al. ..... 381/191
4,207,442 A * 6/1980 Freeman ..... 381/116
4,246,448 A * 1/1981 Tam et al. ..... 381/116
5,388,163 A * 2/1995 Elko et al. ..... 381/116
5,392,358 A * 2/1995 Driver ..... 381/191

FOREIGN PATENT DOCUMENTS

DE 2444023 A1 3/1975
EP 0084608 A1 8/1983

* cited by examiner

*Primary Examiner*—Sinh Tran
(74) *Attorney, Agent, or Firm*—Smith, Gambrell & Russell

(57) ABSTRACT

The invention relates to an acoustic element and method for sound processing. The acoustic element (1) is made of a porous stator plate (2) which is either electrically conductive or plated on at least one of its surfaces to be conductive. A moving diaphragm (3, 3*a*, 3*b*) has been attached to the stator plate (2). To measure as well as produce sound pressure and particle velocity, the equipment comprises two pairs of aforementioned acoustic elements (1). Elements serving as sensors control elements serving as actuators to attenuate and absorb sound.

15 Claims, 6 Drawing Sheets

ACOUSTIC ELEMENTS AND METHOD FOR SOUND PROCESSING

Figure 1A:
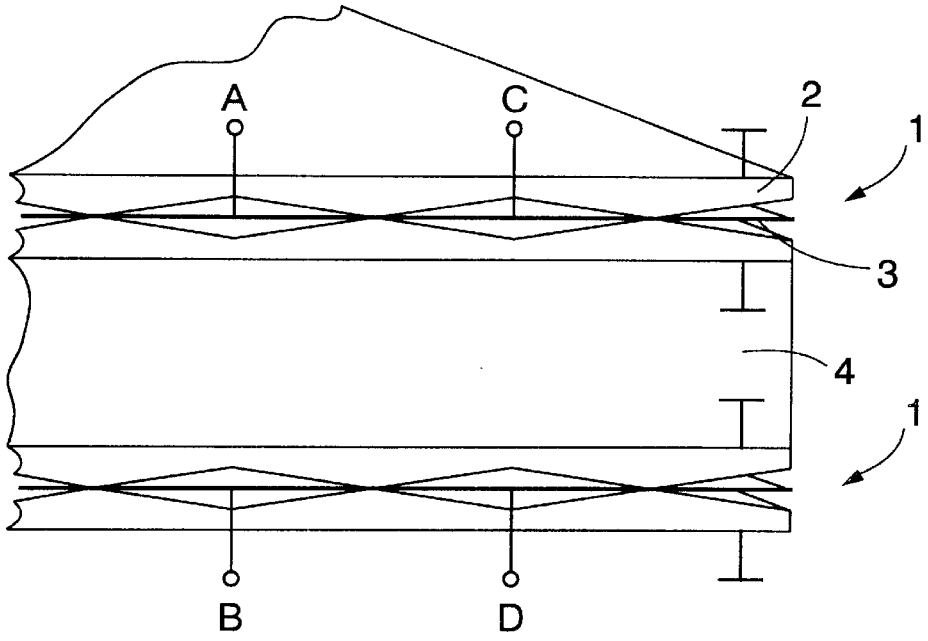

The present invention relates to an acoustic element having a plate-like structure.

The method further relates to a method for sound processing, in which at least at least one property of a sound field is measured, and on the basis of the measurement result an attenuation sound is produced by at least one actuator.

In order to determine acoustic variables, both the sound pressure and the particle velocity must be known. These may also be used to determine acoustic impedance, which is the quotient of the sound pressure and the particle velocity. To control acoustic properties by active control methods and equipments, it must be possible to measure and adjust the aforementioned variables.

It is known to employ an electrostatic loudspeaker made of perforated plate for producing sound. The loudspeaker has a plate-like structure, but its drawbacks include a strong resonating tendency of the plate structure. In addition, electric shielding of the structure is problematic.

It is the object of the present invention to provide a simple and efficient acoustic element and method for sound processing.

The acoustic element according to the invention is characterized by comprising at least one porous stator plate which is either electrically conductive or plated on at least one side to be electrically conductive, and at least one moving diaphragm with at least one electrically conductive surface.

The method according to the invention is further characterized in that at least two dipole sensors and at least two dipole actuators, said sensors and actuators consisting of at least one porous stator plate which is either electrically conductive or plated on at least one of its sides to be electrically conductive and of at least one moving diaphragm with at least one electrically conductive surface, constitute a sandwich structure in which the sensor signals are coupled to control the moving of the dipole actuators for adjusting the sound pressure and the particle velocity to match the desired value signals.

The basic idea of the invention is that the acoustic element consists of at least one porous stator plate which is electrically conductive or plated on at least one of its surfaces to be electrically conductive, and of at least one dielectric moving diaphragm with at least one electrically conductive surface. The idea of another embodiment is that the element consists of at least two porous stator plates and a moving dielectric diaphragm between them. The idea of yet another embodiment is that the moving diaphragm is permanently charged as an electret diaphragm. Further, the idea is that the elements according to the invention constitute a sandwich structure so that it has at least two dipole sensors and at least two dipole actuators, the sensor signals being coupled to control the moving of the actuators for adjusting the sound pressure and the particle velocity to match the desired value signals.

The invention provides the advantages that the element has a simple structure, problems resulting from resonating are non-existent, and its electric shielding is easy. Further, the sandwich structure contributes to efficient production, measurement and attenuation of sound.

Figure 1B:
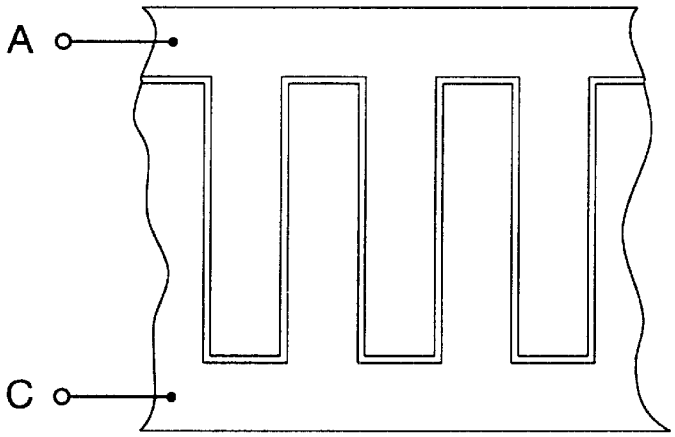
Figure 1C:
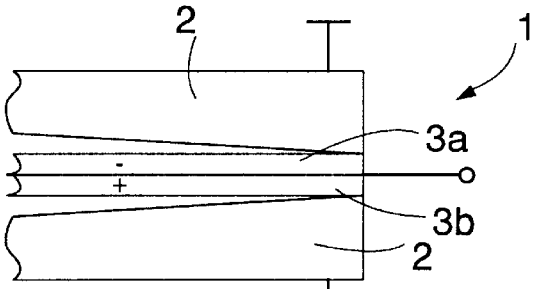

The invention will be described in more detail in the accompanying drawings, in which FIG. 1*a* shows schematically a perspective view of a part of the equipment according to the invention, FIG. 1*b* shows a top view of a part of the equipment in FIG. 1*a* cut open, FIG. 1*c* shows a side view of a part of the equipment in FIG. 1*a,*

Figure 2A:
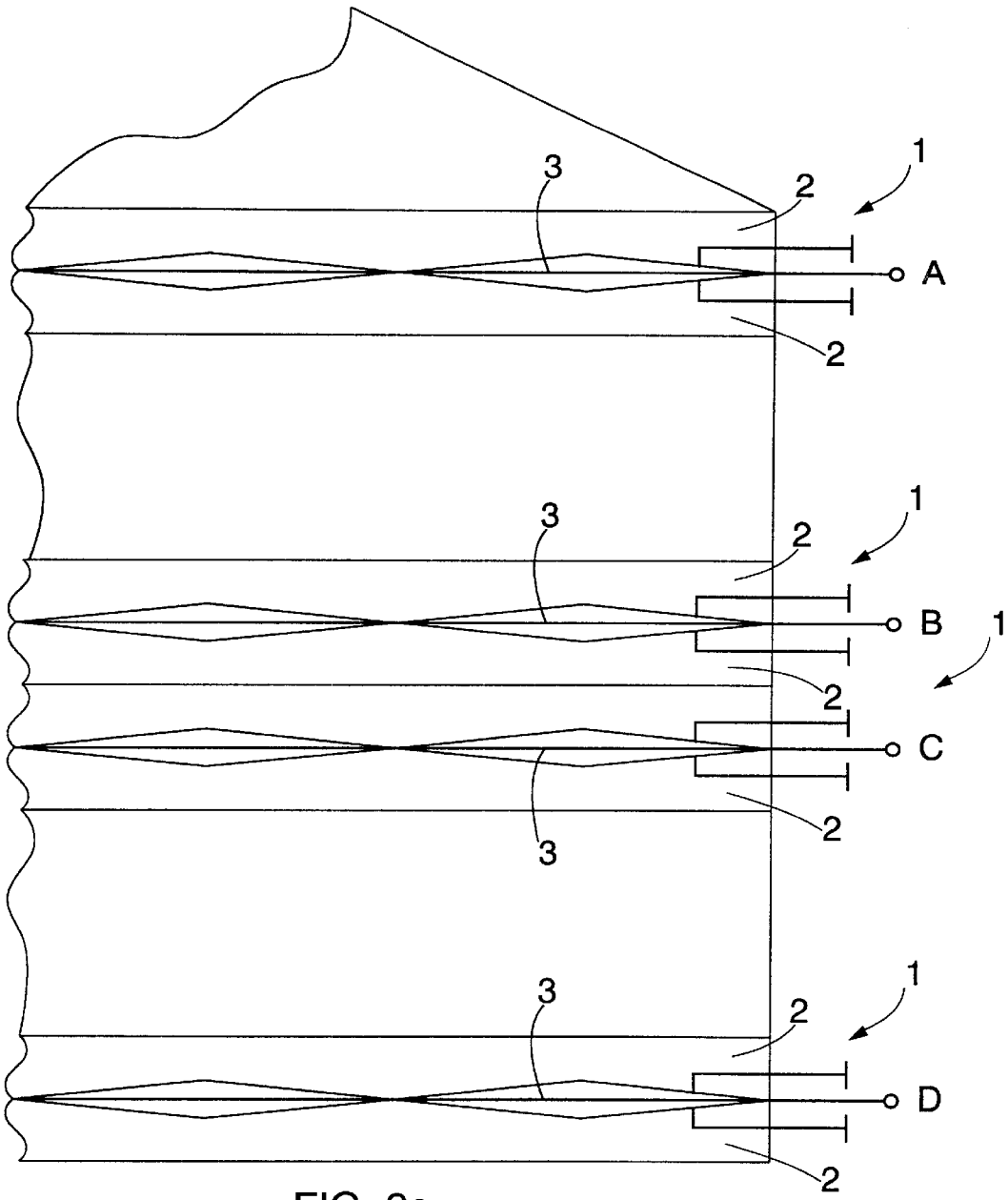
Figure 2B:
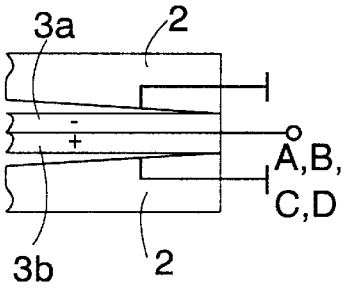
Figure 2C:
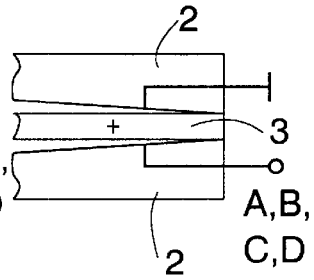
Figure 2D:
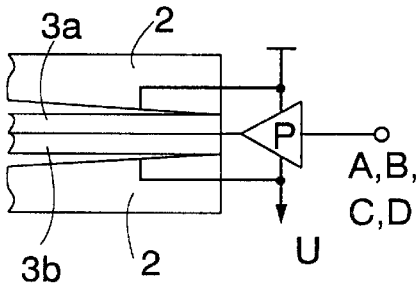

FIG. 2*a* shows schematically a perspective view of a part of another equipment according to the invention, FIGS. 2*b*–2*d* illustrate alternative details of the equipment according to FIG. 2*a,*

Figure 3:
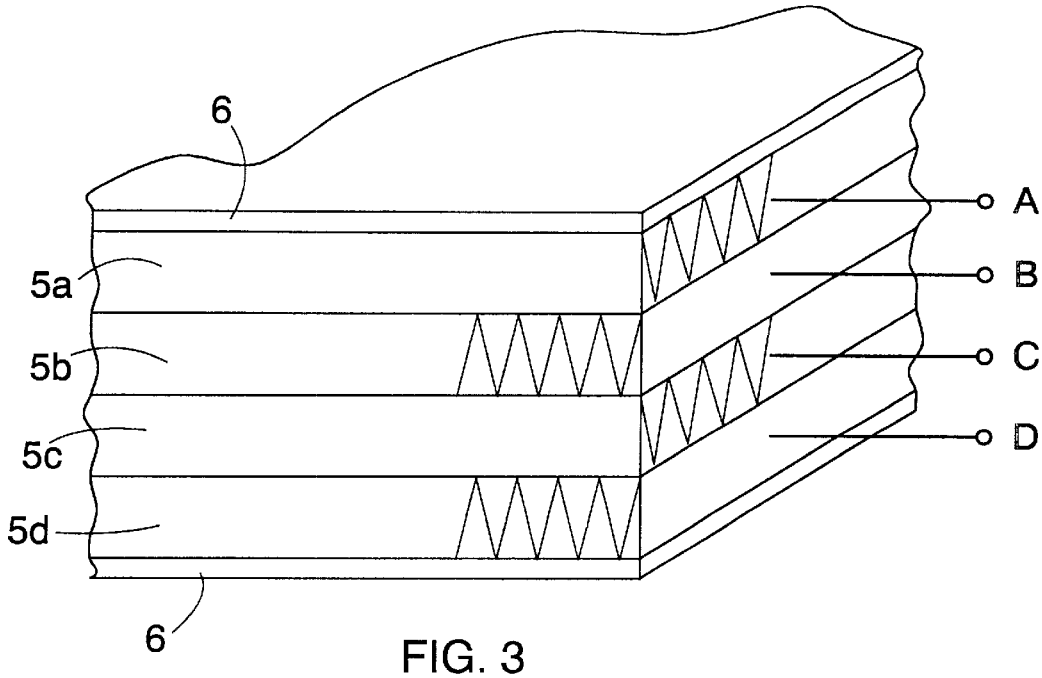
Figure 4:
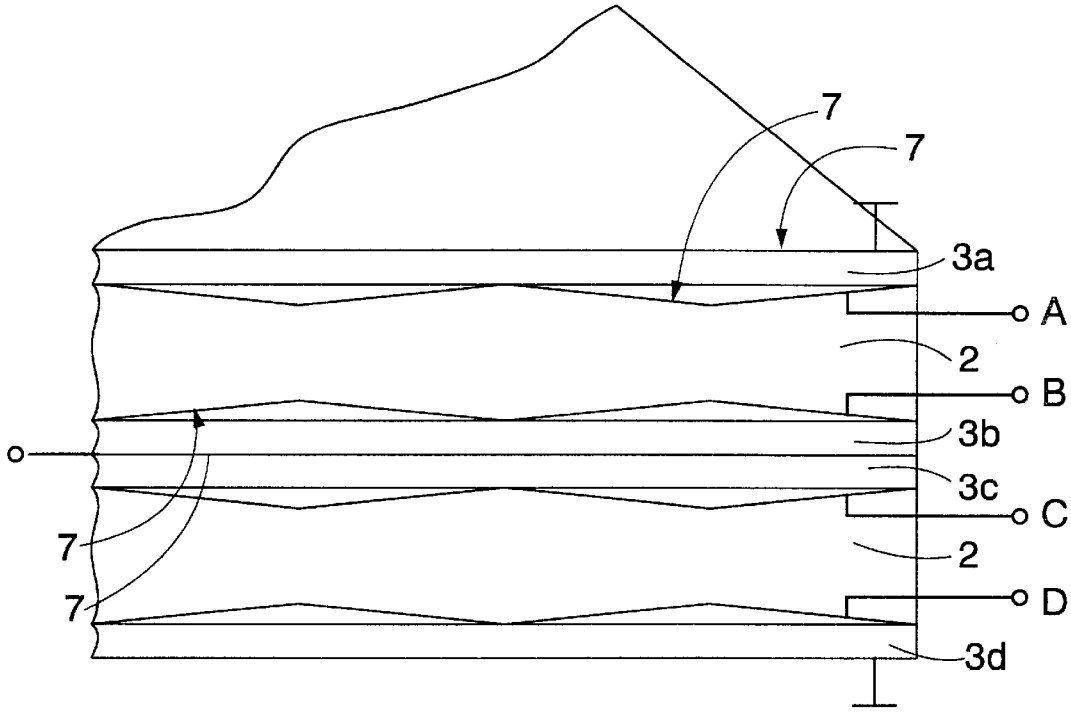
Figure 5:
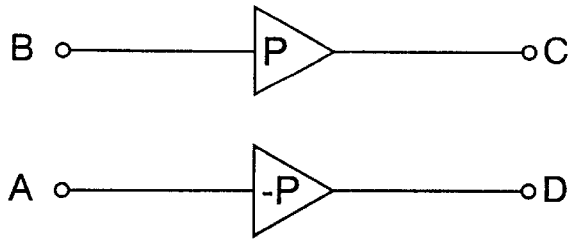
Figure 6:
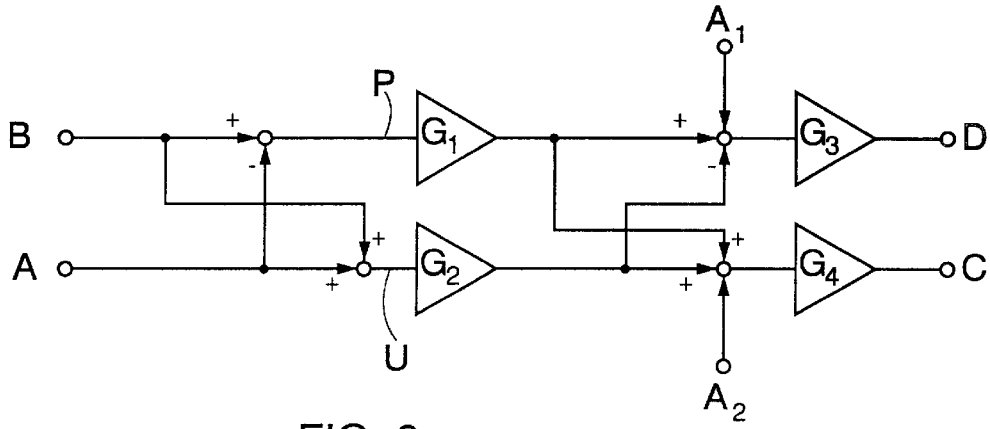
Figure 7:
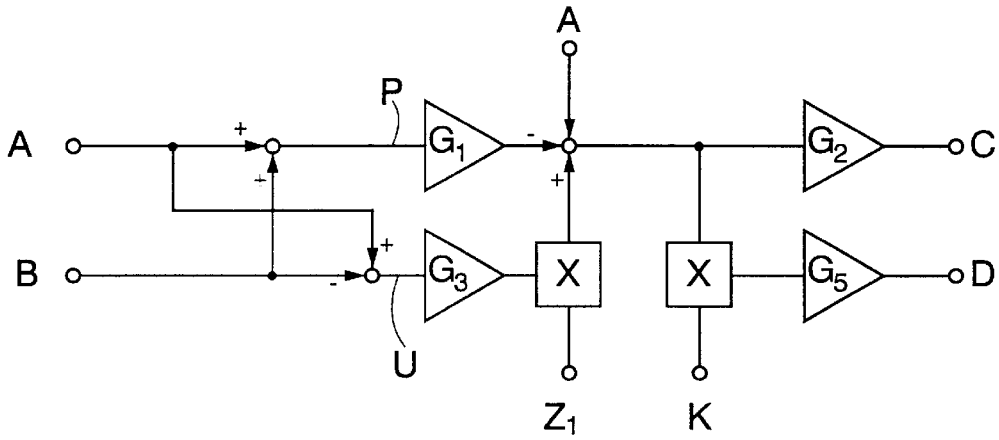
Figure 8:
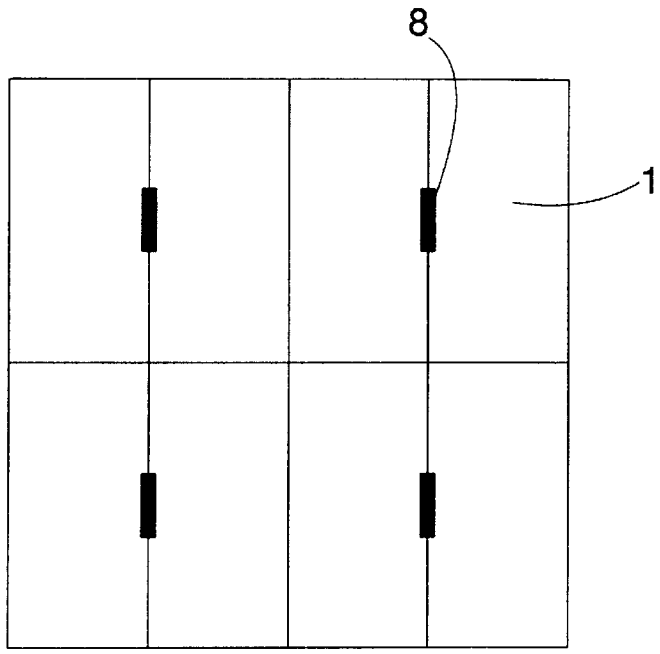
Figure 9:
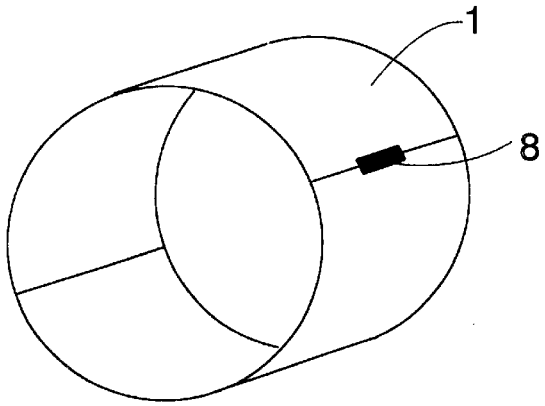
Figure 10:
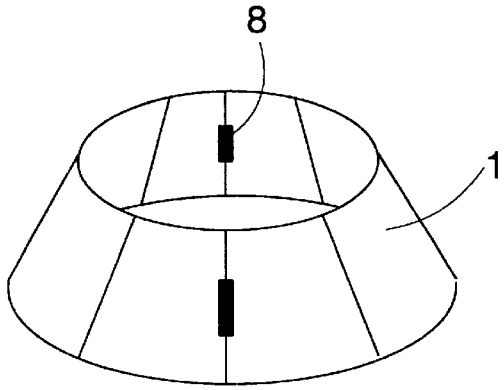
Figure 11:
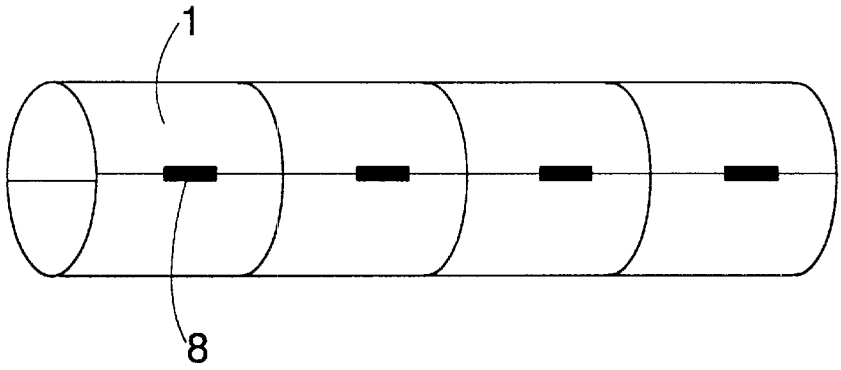
Figure 12:
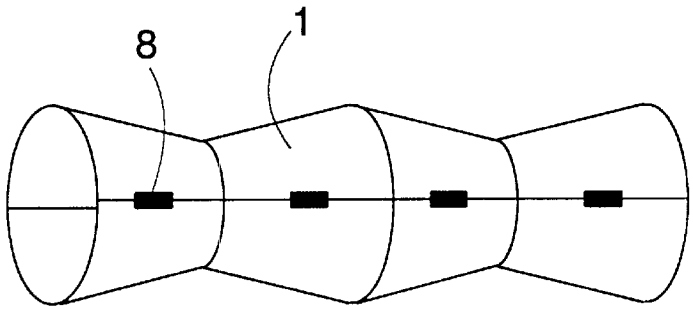
Figure 13:
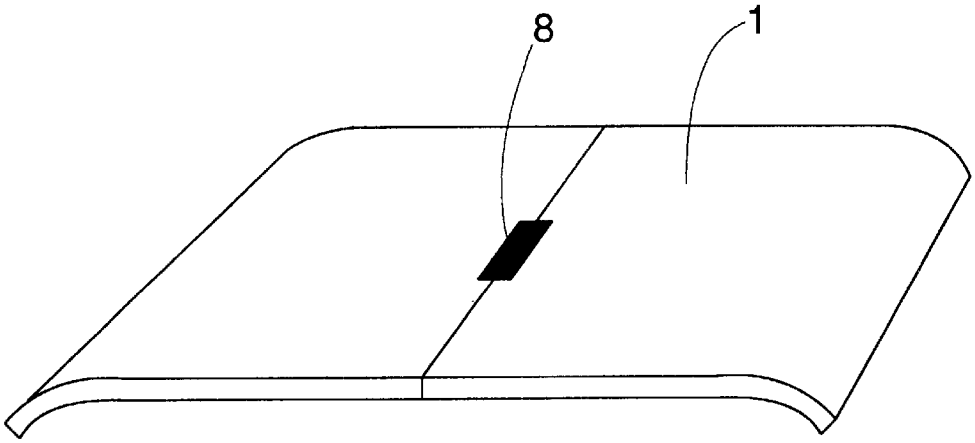

FIG. 3 is a schematic representation for a third actuator element as a perspective view, FIG. 4 is a schematic representation for a fourth actuator element as a perspective view, FIGS. 5–7 show alternatives to schematic diagrams of the method according to the invention, and FIGS. 8–13 are schematic representations for alternative geometric shapes of the inventive element.

FIG. 1 shows an equipment with two acoustic elements 1 on top of one another as a lamellar structure. The acoustic element 1 comprises two porous electrically conductive stator plates 2, between which has been arranged a permanently charged moving diaphragm 3. The surface against the diaphragm 3 of the stator plate is slightly wavy, whereby small air gaps will remain between the moving diaphragm 3 connected thereto and its surface, the small air gaps enabling the movement of the diaphragm 3. As indicated by FIG. 1*c*, the moving diaphragm 3 consists of two separate diaphragms, the upper diaphragm 3*a* of which has a negative charge and the lower diaphragm 3*b* a positive charge. Electrodes A, B, C and D have been formed between the diaphragms 3*a* and 3*b*. As shown by FIG. 1*b*, the electrodes A, B, C and D are finger-figure electrodes, which means that the electrodes A and C, and correspondingly B and D may be positioned interleaving in the same layer. From the electrodes A, B, C and D, either a signal corresponding to the movement of the electrode may be measured, or the movement of the diaphragm may be produced by applying a control voltage to the electrodes. The electrically conductive stator plates are grounded. Between the acoustic elements 1 there is intermediate material 4, which may be material absorbing sound passively, such as glass fiber plate, in which the glass fibers are perpendicular to the element plane.

An advantageous embodiment of the invention is represented by one where the measured signal of the electrode A is coupled, amplified with coefficient −P, to the movement-producing element D, and the movement signal measured from the electrodes B is coupled, amplified with coefficient P, to the electrode C, as illustrated by FIG. 5. This produces a control corresponding both to the sound pressure and the particle velocity for producing a reverse sound field and for preventing the sound field from propagating through the element in noise attenuation embodiments.

FIG. 2 illustrates an equipment having four identical acoustic dipole elements 1 connected to each other by intermediate material 4. The stator plates 2 are made of porous plastic plate whose inner surface has been metal-coated by evaporation. The metal-coated inner surface in question is grounded. The moving diaphragm 3 may be made of two plastic diaphragms 3*a* and 3*b* between which there is provided a metallized layer to which the control signal is applied, or from which the measured signal is obtained as shown by FIG. 2*d*. The diaphragms may also have electric charges of different polarities, whereby an external bias voltage source is not required, as shown by FIG. 2*b*. It is also possible to employ one charged diaphragm 3, whereby one of the electrodes of the stator plates 2 is grounded, and the other serves as the signal electrode, as shown by FIG. 2*c*. Also in the embodiment of FIG. 2*a*, any element 1 may serve in sound measuring and sound producing capacity.

FIG. 3 shows an embodiment in which four folded dipole elements 5*a*–5*d* known per se are interconnected, and the elements are coated with a porous layer 6. In this embodiment, too, any electrode A–D may serve as a sensor or an actuator.

FIG. 4 illustrates an equipment having atop a moving diaphragm 3*a*, whose upper surface has a metal coating 7. Below this, a stator plate 2 is found which has a metal coating 7 on both sides. The moving diaphragms 3*a* and 3*b* are in the middle with a conductive layer between them. As to their bottom parts, the electrodes of the equipment are mirror images of the upper part.

It is typical of all the above equipments illustrated in the Figures is that the sum of two signals e.g. A+B correspond to the sound pressure and the difference A−B corresponds to particle velocity. Similarly, by controlling the elements C and D in a cophasal manner it is possible to implement a monopole actuator producing sound pressure, and by controlling the elements C and D in a differential phase it is possible to implement a dipole actuator producing particle velocity. The aforementioned principle is applicable in many ways to sound reproduction equipments, active sound controlling, acoustic correction, and to embodiments of active noise attenuation.

A most advantageous control method is shown by FIG. 5, implementing the principle of attenuating sound transmissivity, in which a sound pressure sensor controls the particle velocity actuator and a particle velocity sensor controls the sound pressure actuator. To implement the control principle, the signal B needs to be amplified with a coefficient P which corresponds to the control signal of the actuator C. The signal of the sensor A must be amplified with a coefficient −P to implement the aforementioned control principle. The control may also be implemented in the inverse way, with the electrode D controlling the electrode A, and the electrode C controlling the electrode B.

FIG. 6 illustrates a corresponding control principle in which the frequency-dependent properties of the system may be adjusted with a variable gain amplifier $G_1$–$G_4$. Audio signals may be applied to the system also from connectors $A_1$ and $A_2$.

FIG. 7 illustrates a control principle by means of which the acoustic impedance of the element may be adjusted. The difference of the sound pressure and the desired impedance Z×particle velocity is applied to the electrode C. With very high gain of $G_2$, the aforementioned difference approaches zero, which fulfills P=Z×U, i.e. Z=P/U, which is the equation for acoustic impedance. Acoustic impedance may therefore be adjusted by adjusting the coefficient $Z_1$. By adjusting the coefficient K, the backward radiation of the element may be adjusted to zero.

FIGS. 8–13 illustrate physical structures of the acoustic elements. The structures may be planar, cylindrical, conical or even three-dimensionally arched surfaces. The elements may consist of a plurality of acoustic elements 1 with integrated control electronics 8 at their edges. Many of the accompanying drawings show the acoustic elements 1 schematically as totally flat, although they possess some dimensionality in the thickness direction. Cylindrical and conical modules and combinations thereof are particularly well suited for noise attenuation of air-conditioning systems as they are capable of both absorbing noise within a duct made of modules and of attenuating sound that leaks out through the duct wall. The planar elements can both produce sound according to an audio signal and simultaneously absorb noise or adjust e.g. reverberation time by adjusting acoustic impedance according to the desired value $Z_1$. Due to their rigidity, the modules may be used as the load-bearing structure as such. The surface layers serve as both electrical and mechanical shields, and they may be coloured or patterned as desired. The white surface may also be used as a background for a picture to be reflected.

The drawings and the description related thereto are only intended to illustrate the idea of the invention. The invention may vary in details within the scope of the claims. As the modules also contain components that absorb sound passively, the modules may be used for attenuating and absorbing sound in the entire sound spectrum, although the active, electronically implemented portion in the system works best within the frequency range 0–1 kHz. Hence, it is worth while to filter frequencies higher than this off the control system. The simplest implementation of the invention may be an element having a porous metallized plate in the inner surface, with a moving diaphragm arranged in the surface of the plate. Such a sound element may also be rolled up. It should be noted that porous stator plates as such attenuate high frequencies and prevent harmful acoustic reflections. Several attenuating elements according the invention may be placed on top of each other to add to the efficiency. A wall structure with two elements positioned facing each other as a mirror image is most advantageous.

What is claimed is:

1. An acoustic element having a plate-like structure, comprising first and second porous stator plates which are either electrically conductive or plated on at least one side to be electrically conductive, and at least one moving diaphragm with at least one electrically conductive surface, and said diaphragm being arranged for movement in relation to said stator plate, wherein said first and second stator plates are arranged symmetrically to opposite sides of said diaphragm and said diaphragm being arranged for movement toward and away from each of said first and second stator plates; and wherein each of said stator plates includes a facing surface facing said diaphragm with the facing surface of each stator plate being formed such that air gaps are formed between the diaphragm and the stator plates and wherein said diaphragm is arranged to move symmetrically relative to said first and second stator plates.

2. An acoustic element as claimed in claim 1, wherein the moving diaphragm is permanently charged as an electret diaphragm.

3. An acoustic element as claimed in claim 1, wherein the moving diaphragm comprises two diaphragms, between which there is provided two finger-figure electrodes in one layer.

4. An acoustic element as claimed in claim 1, further comprising acoustic element control electronics with said control electronics being positioned at the edge of the element.

5. An acoustic element device comprising two or more of said acoustic element of claim 1 arranged on top of each other as a stacked structure.

6. An acoustics element device as claimed in claim 5, wherein between the acoustic elements positioned on top of each other there is provided porous intermediate material that absorbs noise passively.

7. An acoustic element as claimed in claim 1 wherein said air gaps include a wavy surface pattern formed in said stator plates.

8. An acoustic element in claim 1 wherein said diaphragm is arranged with respect to said air gaps such that said diaphragm is free to move in a sound producing fashion.

9. An acoustic element as claimed in claim 1 wherein said air gaps are defined by a wavy surface pattern in said first and second stator plates and within which said air gaps said diaphragm extends during movement relative to said first and second stator plates.

10. An acoustic element as claimed in claim 1 wherein said stator plates have a wavy surface pattern defining said air gaps within which said diaphragm deflects into during relative movement of said diaphragm relative to said stator plates.

11. A method for sound processing, in which at least one property of a sound field is measured, and on the basis of the measurement result an attenuation sound is produced by at least one actuator, wherein the method for sound processing involves at least two dipole sensors and at least two dipole actuators, said sensors and actuators comprising at least one porous stator plate which is either electrically conductive or plated on at least one of its sides to be electrically conductive and of at least one moving diaphragm with at least one electrically conductive surface, wherein said stator plate and said diaphragm constitute a stacked structure in which the sensor signals are coupled to control the moving of the dipole actuators for adjusting the sound pressure and the particle velocity to match the desired value signals, first, second, third and fourth electrodes are provided as sound pressure or particle velocity actuators and wherein the first electrode serving as one of said sensors controls the second electrode serving as one of said actuators, multiplied by a coefficient −P, and the third electrode serving as one of said sensors controls the fourth electrode serving as one of said actuators, multiplied by a coefficient P.

12. A method as claimed in claim 11, wherein a signal corresponding to the sound pressure is formed from the sum of the sensor signals, and that a signal corresponding to the particle velocity is formed from the difference of the signals to adjust the movements of the actuators.

13. A method for sound processing, in which at least one property of a sound field is measured, and on the basis of the measurement result an attenuation sound is produced by at least one actuator, wherein the method for sound processing involves at least two dipole sensors and at least two dipole actuators, said sensors and actuators comprising at least one porous stator plate which is either electrically conductive or plated on at least one of its sides to be electrically conductive and of at least one moving diaphragm with at least one electrically conductive surface, wherein said stator plate and diaphragm constitute a stacked structure in which the sensor signals are coupled to control the moving of the dipole actuators for adjusting the sound pressure and the particle velocity to match the desired value signals, said method further comprising forming a product of the particle velocity signal and the impedance control coefficient $Z_1$, subtracting the sound pressure signal from said product to provide a difference value, amplifying the difference value by a gain coefficient ($G_2$), and inputting this signal to control the movements of the actuators.

14. A method as claimed in claim 11, wherein, between the dipole actuators, sound is attenuated by means of porous intermediate material that absorbs sound passively.

15. A method as recited in claim 11 wherein said stator plate is slightly wavy so as to define small air gaps in which said moving diaphragm extends in moving relative to said stator plate.

* * * * *